United States Patent [19]

Fishback et al.

[11] 4,257,878

[45] Mar. 24, 1981

[54] BENEFICIATION PROCESS FOR OIL SHALE

[75] Inventors: J. William Fishback, Arvada; Dennis E. Petticrew, Denver, both of Colo.

[73] Assignee: The Superior Oil Company, Houston, Tex.

[21] Appl. No.: 29,021

[22] Filed: Apr. 12, 1979

[51] Int. Cl.[3] ..... B03B 5/00; C10G 1/00

[52] U.S. Cl. ..... 209/2; 209/17; 209/269; 208/11 LC

[58] Field of Search ..... 209/2–5, 209/17, 268, 269, 270, 273, 315, 355; 208/11 R, 11 LE

[56] References Cited

U.S. PATENT DOCUMENTS

| | | | |
|---|---|---|---|
| 3,159,562 | 12/1964 | Bichard et al. | 208/11 LE |
| 3,392,828 | 7/1968 | Muller | 209/270 X |
| 3,407,003 | 10/1968 | Durie | 208/11 LE X |
| 3,596,759 | 8/1971 | King et al. | 209/2 |

*Primary Examiner*—Ralph J. Hill

*Attorney, Agent, or Firm*—Arnold, White & Durkee

[57] ABSTRACT

A beneficiation process for increasing the oil content of clay-bearing oil shale ore wherein the oil shale ore is subjected to an aqueous medium, agitated to disintegrate at least a portion of the clay, and the disintegrated clay is separated from the remaining oil shale to yield an oil shale having a greater amount of recoverable hydrocarbon values per ton than the unprocessed oil shale ore.

10 Claims, 2 Drawing Figures

BENEFICIATION PROCESS FOR OIL SHALE

BACKGROUND OF THE INVENTION

Field of the Invention

The invention relates to a beneficiation process for upgrading mined oil shale prior to retorting for recovery of the oil.

Large deposits of oil shale are found in many locations throughout the world, and extensive efforts have been undertaken to develop oil shale as a source of hydrocarbon products. The term "oil shale" is widely used to refer to a layered sedimentary formation containing an organic material known as kerogen, which may be decomposed by heating to produce gaseous and liquid hydrocarbon products. Such processing of the oil shale may be conducted in place in the deposit (in situ) or the oil shale may be mined by conventional mining methods and the oil shale ore processed by retorting on the surface. In such retorting, particles of mined oil shale are heated over a period of time and to an appropriate temperature to yield gaseous and liquid hydrocarbon fractions. Two examples of such retorts and retorting processes are those described in U.S. Pat. Nos. 3,821,353, and 4,133,741, both of which are assigned to the assignee of the present invention.

Because of the high temperatures required in known retorts and retorting processes for obtaining hydrocarbon values from oil shale, and the resultant need for large amounts of energy to provide such heat, it is desirable to retort as little oil shale as possible to obtain each gallon of oil. It has been found that some oil shale deposits have large amounts of retained water, up to 30% water by weight, in contrast to other known oil shale deposits having less than 4% water by weight. The retorting of oil shales having such a high water content requires increased amounts of heat energy to evaporate the excess retained water.

It has also been determined that this damp oil shale has cohesive tendencies attributable to the presence of bonded finely divided particles of a clay-like material of nominally minus 100 mesh, which has a lower cohesive strength than the larger oil shale particles. Throughout this application and in the appended claims the term "clay" will refer to this clay-like material. This clay also has been found to contain less recoverable hydrocarbons, or oil, per ton than the larger particles of that particular oil shale.

Thus, in retorting this clay-bearing oil shale ore, additional energy must be supplied to the retort to evaporate the additional water and to retort large quantities of the clay which has a lower oil content.

SUMMARY OF THE INVENTION

In accordance with the invention, a beneficiation process has been developed for upgrading oil shale ore containing clay. The beneficiation process of the present invention comprises the steps of subjecting mined clay-bearing oil shale ore to an aqueous medium, agitating the ore in the presence of the medium to disintegrate at least a portion of the clay, separating the disintegrated clay from the remaining oil shale, and recovering the remaining oil shale.

A feature of the present invention resides in the fact that the aqueous medium is water, and the oil shale ore is subjected to agitation in the presence of the aqueous medium by submerging, spraying, or pouring the aqueous medium on the oil shale ore.

The beneficiation process of the present invention upgrades the oil shale ore which will then be retorted after the beneficiation process has been performed, whereby the oil shale which is retorted does not include a portion of the clay having the lower oil content. Accordingly, the oil shale which is retorted contains more oil per ton than does the oil shale ore prior to the beneficiation process.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
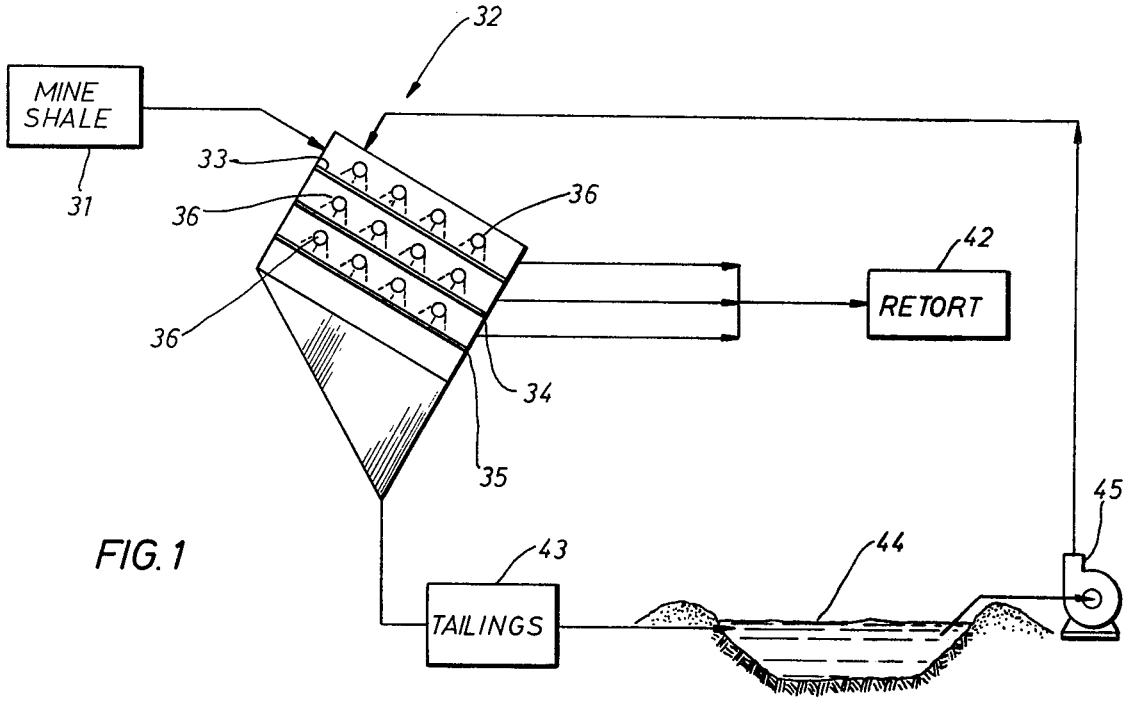
FIG. 1 is a schematic view of one apparatus suitable for use with, and illustrates, the beneficiation process of the present invention.

Turning first to FIG. 1, one embodiment of a process according to the present invention will be described with reference to the schematic drawing, it being understood that the apparatus used for the various steps of the process is of conventional form and need not be described in detail.

The feed material for the process is oil shale ore of the type discussed above, i.e., containing the clay-like material ("clay") and having a water content of from 10 to 30% by weight of the oil shale ore. The oil shale ore is mined by appropriate means; mining step 31 being any conventional method for mining oil shale, such as open pit mining, with such crushing or other conventional size reduction as may be necessary to obtain ore particles of a size convenient for further processing. The clay has a lower cohesive strength than the other larger particles of the oil shale. The mined oil shale ore from mining process 31 preferably will be oil shale ore particles having a greatest dimension of five inches or less.

The mined clay-bearing oil shale ore is conveyed into apparatus 32 for subjecting the oil shale ore to an aqueous medium and agitating the ore to disintegrate at least a portion of the clay. From apparatus 32, to be hereinafter described, an oil-rich portion of the oil shale ore is recovered and conveyed to a conventional oil shale retort 42, wherein the oil shale is heated over a period of time and to an appropriate temperature to yield gaseous and liquid hydrocarbon fractions.

In apparatus 32, the oil shale ore is subjected to an aqueous medium to disintegrate at least a portion of the clay from the remaining oil shale. The disintegrated clay is separated from the oil shale in apparatus 32, and the disintegrated clay, or tailings, 43 is conveyed to a tailings pond 44, where it settles to the bottom. A conventional water pump 45 may be used for recirculating the aqueous medium, or water, back into apparatus 32.

Apparatus 32, for subjecting the mined oil shale ore to an aqueous medium, or water, to disintegrate at least a portion of the clay, may include a plurality of water washed screens 33–35, screens 33–35 each having openings of a different size. Water is sprayed upon the oil shale ore via a plurality of water outlets 36 disposed above each screen 33–35. Although the aqueous medium utilized is water, other aqueous media may be utilized which will serve the function of disintegrating at least a portion of the clay in the oil shale ore. It will be appreciated that the agitation provided to disintegrate the cohesively bonded clay should be relatively mild, so as not to break up the oil shale into particles which will be separated with the disintegrated clay fraction.

The sizes of the screens 33–35 are progressively smaller, the last screen 35 preferably being of from 28 to 100 mesh. The disintegrated clay, having a nominal size of less than 100 mesh, will pass through this last screen 35 of apparatus 32 and become tailings 43 which are conveyed to tailings pond 44. The larger sized particles of the oil shale ore, being larger than the smallest screen openings of apparatus 32, are recovered in a conventional manner by removing them from above screens 33–35. This remaining oil shale is then conveyed to retort 42, as previously described.

Figure 2:
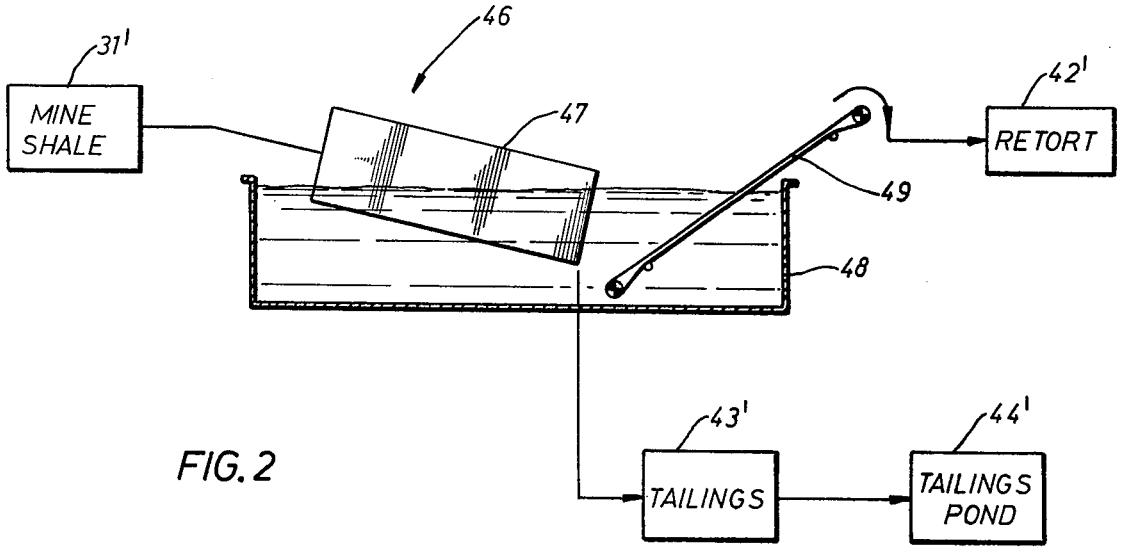
FIG. 2 is a schematic view of another apparatus suitable for practicing, and illustrating, the beneficiation process of the present invention.

Turning now to FIG. 2, another apparatus for practicing the present invention is shown. The oil shale mining step 31' and retorting step 42' are the same as mining and retorting steps 31 and 42 previously described. Additionally, tailings pond 44' may be the same as tailings pond 44 previously described and may also include a pump 45. Apparatus 46 for subjecting the clay-bearing oil shale ore to an aqueous medium to disintegrate at least a portion of the clay in the oil shale ore is shown to be a water submerged trommel 47 disposed in a tank of water 48. The mined oil shale ore is conveyed into the trommel 47, wherein the oil shale ore is conventionally agitated by vibration or rotation on the screen or screens (not shown) of trommel 47, until at least a portion of the clay in the oil shale ore is disintegrated and passes through the screen or screens of trommel 47 to the bottom of tank 48. Thereafter the disintegrated clay, or tailings, 43' is removed from tank 48 in a conventional manner. The tailings 43' are then conveyed to the tailings pond 44'. Trommel 47 is provided with a suitable opening (not shown) which allows the remaining oil shale which does not pass through the screens of trommel 47 to be removed and deposited upon any suitable means for conveying the remaining oil shale to retort 42'. A conveyor belt 49 may be used to convey the upgraded oil shale from trommel 47 to retort 42'.

The oil shale ore particles from mining step 31' will also have a size on the order of five inches or less in greatest dimension, and the screen or screens of trommel 47 will serve to allow the disintegrated clay fraction 43' to pass through a screen having a size of from 28 to 100 mesh.

Although screens having a size of 100 mesh are suitable for separating the disintegrated clay from the oil shale, it has been found that screens of 28 mesh are commercially practicable for efficient separation of the disintegrated clay from the oil shale without excessive loss of hydrocarbon-bearing particles. Accordingly, a smaller amount (weight) of the recovered oil shale must be processed by retort 42 or 42' to produce a given amount of oil, and the upgraded oil shale which is processed in retort 42 or 42' has a greater amount of oil per ton than the initial oil shale ore from mining step 31 or 31'.

Table I below represents typical results from utilizing the beneficiation process of the present invention in conjunction with an apparatus similar to that disclosed in FIG. 1.

TABLE I

| | Grade* | % Available Hydrocarbons (by volume) | % Total Weight |
|---|---|---|---|
| Before Beneficiation | | | |
| Mine Oil Shale | | | |
| Ore Size | | | |
| −3" + 0 | 30.6 | 100 | 100 |
| After Beneficiation | | | |
| Upgraded Oil Shale Size | | | |
| −3" + 28 mesh | 38.0 | 92.7 | 75.3 |
| Tailings Size | | | |
| −28 mesh | 9.0 | 7.3 | 24.7 |

*All grade values are gallons of oil per ton of ore as determined by the conventional Fischer Assay analysis.

As shown in Table I the grade of the mined oil shale ore having a size from 0 to 3 inches is 30.6 gallons of oil per ton. After conducting the beneficiation process of the present invention, the upgraded oil shale has a size of from 28 mesh to 3 inches and a grade of 38.0 gallons of oil per ton. The tailings 43, or disintegrated clay, which pass through the 28 mesh screen and are separated from the oil shale to be retorted, comprise 24.7% by weight of the initial mined oil shale ore on a dry basis and contain only 7.3% of the recoverable liquid hydrocarbons in the mined oil shale ore. Hence 24.7% less feed is processed in retort 42 to obtain the same oil yield, or 24% more oil can be recovered from a given tonnage of oil shale feed to the retort. Accordingly, the upgraded oil shale produced by the beneficiation process of the present invention comprises 75.3% by weight of the initial mined oil shale ore (dry basis) but contains 92.7% of the liquid hydrocarbons available from the original ore. The increase of 7.4 gallons of oil per ton of feed to the retort (dry basis) is an increase of 24% over the raw mined oil shale ore not processed in accordance with the present invention.

Table II below illustrates typical results for oil shale ore processed in accordance with the present invention when utilizing apparatus such as that shown in FIG. 2, with a 28 mesh screen used to separate the disintegrated clay from the remaining oil shale, whereby the upgraded oil shale has a size from 28 mesh to 3 inches. It is seen that after practicing the beneficiation process of the present invention, the upgraded oil shale has an increase of 4.7 gallons of oil per ton, or an increase of 14.8%, and the disintegrated clay, or tailings, 43' represents 14.9% by weight less material which must be processed in retort 42' to produce the same oil yield, or 14.8% more oil may be recovered per ton of oil shale feed to the retort.

TABLE II

| | Grade* | % Available Hydrocarbons (by volume) | % Total Weight |
|---|---|---|---|
| Before Beneficiation | | | |
| Mined Oil Shale | | | |
| Oil Size | | | |
| −3" + 0 | 31.8 | 100 | 100 |
| After Beneficiation | | | |
| Upgraded Oil Shale Size | | | |
| −3" + 28 mesh | 36.5 | 97.7 | 85.1 |
| Tailings Size | | | |

TABLE II-continued

| | Grade* | % Available Hydrocarbons (by volume) | % Total Weight |
|---|---|---|---|
| −28 mesh | 5.0 | 2.3 | 14.9 |

*All grade values are gallons of oil per ton of ore as determined by the conventional dry basis Fischer Assay analysis Although practicing the beneficiation process of the present invention involves subjecting the oil shale ore to an aqueous medium, or water, to disintegrate at least a portion of the clay in the mined oil shale ore, it has been observed that the moisture content of the upgraded oil shale is not increased beyond what it was prior to the performance of the beneficiation process. Accordingly, in the retorting of the oil shale no additional energy is required to evaporate the water found in a ton of the retort feed oil shale; however, less oil shale feed material is retorted per gallon of oil recovered, and the oil shale which is retorted has up to 24% more oil per ton of feed material processed. That is, the beneficiation process substantially increases the recoverable oil per ton of feed to the retort without increasing the amount of energy required per ton of feed to evaporate the water it contains.

The foregoing description of the invention has been directed in primary part to a particular preferred embodiment in accordance with the requirements of the Patent Statutes and for purposes of explanation and illustration. It will be apparent, however, to those skilled in this art that many modifications and changes in this specific process utilized may be made without departing from the scope and spirit of the invention. For example, it will be appreciated that other apparatus may be used in carrying out the beneficiation process disclosed above, the selection of such apparatus being a matter of engineering judgment based on considerations of equipment availability, performance efficiency with respect to the particular oil shale ore, and other economic considerations. To illustrate, the oil shale ore may be subjected to an aqueous medium, agitated sufficiently to disintegrate at least some of the clay, and the clay separated from the remaining oil shale in a screw, rake, or drag classifier of conventional design. In such apparatus, separation of the disintegrated clay from the remaining oil shale is accomplished by classification in the aqueous medium, the larger particles settling faster than smaller particles of equal density. The oil shale concentrate is recovered from the classifier and fed to the retort in the manner described above, and the tailings containing the disintegrated clay particles are similarly treated.

It is the applicants' intention in the following claims to cover such modifications and variations as fall within the true spirit and scope of the invention.

What is claimed is:

1. A beneficiation process for oil shale ore containing cohesively bonded fine grained particles of clay and relatively larger particles of oil shale, comprising the steps of:

subjecting the oil shale ore to an aqueous medium;

agitating the oil shale ore in the presence of the aqueous medium to disintegrate at least a portion of the clay;

separating the disintegrated clay particles from the relatively larger remaining particles of oil shale; and recovering the remaining oil shale.

2. A beneficiation process according to claim 1 wherein the aqueous medium is water.

3. A beneficiation process according to claim 1 wherein the separation is by size classification.

4. A beneficiation process according to claim 3 wherein the size classification is by passing the disintegrated clay particles through a screen having openings of a predetermined size and the remaining oil shale is recovered by removing the oil shale which does not pass through the screen.

5. A beneficiation process for mined oil shale ore containing cohesively bonded fine grained particles of clay and relatively larger particles of oil shale and having a water content of from 10% to 30% by weight, comprising the steps of:

subjecting the oil shale ore to an aqueous medium;

agitating the oil shale ore in the presence of the aqueous medium to disintegrate at least a portion of the cohesively bonded particles;

separating the agitated oil shale ore into a first fraction of relatively larger oil-rich particles and a second fraction of relatively smaller particles; and recovering the first fraction of oil-rich particles for retorting to obtain shale oil therefrom.

6. A beneficiation process according to claim 5 including the step of crushing the mined oil shale ore to provide ore particles having a greatest dimension of five inches or less for subjection to the aqueous medium.

7. A beneficiation process according to claim 5 wherein the step of separating the agitated oil shale ore into first and second fractions comprises screening to yield a first fraction retained on a 28 mesh screen and a second fraction passing through the 28 mesh screen.

8. A beneficiation process according to claim 5 wherein the first fraction of relatively larger particles is separated from the aqueous medium by screening and the second fraction of relatively smaller particles is separated from the aqueous medium by settling and the aqueous medium is then recycled in the process.

9. A beneficiation process according to claim 5 wherein the second fraction of relatively smaller particles is recovered from the aqueous medium and processed for the recovery of shale oil therefrom.

10. A beneficiation process for mined oil shale ore containing cohesively bonded fine grained particles of clay and larger particles of oil shale and having a water content of from 10% to 30% by weight, comprising the steps of:

mining the oil shale ore;

crushing the mined oil shale ore to produce particles having a greatest dimension of five inches or less;

subjecting the crushed ore to an aqueous medium;

agitating the ore in the presence of the aqueous medium to disintegrate at least a portion of the cohesively bonded particles of clay;

separating the agitated oil shale ore into a first fraction of relatively larger oil-rich particles and a second fraction of relatively smaller particles including the disintegrated clay;

recovering the first fraction of oil-rich particles for retorting to obtain shale oil therefrom; and recovering the aqueous medium from the second fraction of smaller particles for reuse in the process.

* * * * *

UNITED STATES PATENT AND TRADEMARK OFFICE

CERTIFICATE OF CORRECTION

PATENT NO. : 4,257,878

DATED : March 24, 1981

INVENTOR(S) : J. William Fishback, Dennis E. Petticrew

It is certified that error appears in the above-identified patent and that said Letters Patent are hereby corrected as shown below:

In The Claims

Insert new claim 11 as follows:

--11. A beneficiation process according to claim 1 wherein the disintegrated clay particles and the relatively larger particles of oil shale are separated from one another in the aqueous medium.--

On The Title Page, "10 Claims" should read -- 11 Claims --.

Signed and Sealed this

*Fifteenth* Day of *September 1981*

[SEAL]

*Attest:*

GERALD J. MOSSINGHOFF

*Attesting Officer*

*Commissioner of Patents and Trademarks*